US007239655B2

(12) United States Patent
Casazza

(10) Patent No.: US 7,239,655 B2
(45) Date of Patent: Jul. 3, 2007

(54) COMPACT HIGH POWER LASER DAZZLING DEVICE

(76) Inventor: Titus A. Casazza, 165 Grandview Dr., Glastonbury, CT (US) 06033

( * ) Notice: Subject to any disclaimer, the term of this patent is extended or adjusted under 35 U.S.C. 154(b) by 0 days.

(21) Appl. No.: 11/399,073

(22) Filed: Apr. 6, 2006

(65) Prior Publication Data

US 2006/0233215 A1 Oct. 19, 2006

Related U.S. Application Data

(60) Provisional application No. 60/671,862, filed on Apr. 16, 2005.

(51) Int. Cl.
*H01S 3/04* (2006.01)

(52) U.S. Cl. ..... 372/36; 372/34; 359/15; 362/259; 362/294

(58) Field of Classification Search ..... 372/34, 372/36; 362/19, 237, 244, 245, 259, 268, 362/33, 1, 294; 359/15
See application file for complete search history.

(56) References Cited

U.S. PATENT DOCUMENTS

| | | | | | |
|---|---|---|---|---|---|
| 4,690,538 | A * | 9/1987 | Matsui et al. | ..... | 396/109 |
| 5,471,327 | A * | 11/1995 | Tedesco et al. | ..... | 359/15 |
| 5,685,636 | A * | 11/1997 | German | ..... | 362/259 |
| 5,734,504 | A * | 3/1998 | Billman | ..... | 359/618 |
| 5,909,062 | A * | 6/1999 | Krietzman | ..... | 307/64 |
| 6,007,218 | A | 12/1999 | German et al. | ..... | 362/259 |
| 6,061,378 | A * | 5/2000 | Marshall et al. | ..... | 372/75 |
| 6,142,650 | A | 11/2000 | Brown et al. | ..... | 362/259 |
| 6,190,022 | B1 | 2/2001 | Tocci et al. | ..... | 362/259 |
| 6,196,702 | B1 * | 3/2001 | Krietzman | ..... | 362/259 |
| 6,431,732 | B1 * | 8/2002 | Brown et al. | ..... | 362/259 |
| 6,616,301 | B2 * | 9/2003 | Brown et al. | ..... | 362/259 |
| 6,787,999 | B2 * | 9/2004 | Stimac et al. | ..... | 315/51 |
| 6,793,364 | B2 | 9/2004 | Cramer et al. | ..... | 362/112 |
| 6,799,868 | B2 * | 10/2004 | Brown et al. | ..... | 362/259 |
| 7,048,408 | B2 * | 5/2006 | Dallas et al. | ..... | 362/202 |
| 2005/0185403 | A1 * | 8/2005 | Diehl | ..... | 362/259 |

* cited by examiner

*Primary Examiner*—Minsun Oh Harvey
*Assistant Examiner*—Yuanda Zhang
(74) *Attorney, Agent, or Firm*—Alix, Yale & Ristas, LLP

(57) ABSTRACT

A compact high power laser dazzling device includes at least one heat sink, multiple laser resonators and an optical head. Each of the laser resonators extends axially from a first end, fixedly mounted to the heat sink, to a second end emitting an individual laser beam. The optical head is disposed adjacent to the second ends of the laser resonators and includes an optical transmission assembly that directs the individual laser beams of the laser resonators to define a region of overlap at a remote point a predetermined distance from the optical head. A laser beam intensity adjuster assembly may be disposed adjacent the output end of the optical head. The laser beam intensity adjuster assembly includes a front face having multiple apertures. At least one of the apertures has a holographic diffuser element mounted therein and at least one of the apertures has an optically clear window element or no optical elements mounted therein.

13 Claims, 6 Drawing Sheets

COMPACT HIGH POWER LASER DAZZLING DEVICE

CROSS-REFERENCE TO RELATED APPLICATIONS

This application claims the benefit under 35 U.S.C. § 119(e) of U.S. Provisional Patent Application Ser. No. 60/671,862 filed Apr. 16, 2005.

BACKGROUND

This disclosure relates generally to the field of portable illumination devices for illuminating an ambient environment. More particularly, the present disclosure relates to a hand-held laser device that could be used as an effective non-lethal security means, whereby temporary visual impairment reduces a subject's ability to engage in disruptive and/or violent actions.

Methods and devices for producing glare or flashblind effects from a portable visual security device have been disclosed for example, in U.S. Pat. No. 5,685,636 to German, in U.S. Pat. No. 6,190,022 to Tocci et al and in U.S. Pat. No. 6,799,868 to Brown et al. among others. These prior art devices operate by producing radiation at intensities sufficient to dazzle a subject by temporarily reducing visual performance while remaining below levels that can result in permanent damage to the subject's retina.

Generally, to ensure that the device is eye safe, it is an accepted practice that the intensity at the location of the target not exceed, one half the maximum permitted exposure (MPE) value for a particular wavelength. In some cases, the device is expected to meet the requirements of ANSI standard, which allows only 10% of the MPE for a given exposure duration. To comply with this requirement, the devices of the prior art were generally limited to intercepting static targets located at or beyond a certain range, or else they allowed adjustments of the power and/or the beam spread of the output radiation to thereby alter the intensity at the estimated target's location in real time.

Means for changing the beam's spread generally involved controlling the spot size using an adjustable lens contained in the device, as was taught, for example, in U.S. Pat. No. 5,685,636. Alternatively, a fixed beam expanding lens could be disposed in the path of the beam, with the power of the output adjustable up to a maximum specified by eye safety considerations. This realization has the advantage of being adaptable to intercepting moving targets in a variety of scenarios and for a range of exposure times, and could be readily packaged in a compact flashlight type device. It had the further advantage of affording a degree of operational and practical flexibility through utilization of Gaussian beam profiles such as are typically produced by most solid state laser sources, including diodes and diode pumped lasers.

Although effective in certain situations, the laser flashlights and visual security devices of the prior art, including the ones taught in the patents cited above, are deficient in that they could not always provide sufficient power to allow use in certain circumstances. Examples of scenarios requiring greater power than available from existing and prior devices may include operation at higher duty cycles, over longer ranges and/or under adverse ambient light conditions such as clear sunny daylight or in rain or foggy conditions. Even the compact laser flashlight device taught in U.S. Pat. No. 6,799,868 is generally limited to less than about 250 mW at the operational wavelength of 532 nm, due to practical considerations of cost and performance. Power levels available at various other visible wavelengths from diode lasers are typically much lower, especially when TEM 00 outputs are required as well.

Generally, power scaling from a single laser emitter, whether a semiconductor laser or a diode pumped solid state laser (DPSSL) is limited by trade-offs between power consumption properties, resonator design limitations (including thermal lensing), sizing of optical components and the amount of battery power available in a portable unit which can restrict the amount of "on" time and/or duty cycle. Furthermore, the cost of the components tend increase substantially as the power is scaled, putting the device beyond reach for certain security applications. It is therefore desirable to provide a cost effective security device with scalable output power outputs of 1 W and beyond in the visible, while maintaining portability features and effectiveness.

SUMMARY

There is provided a compact high power laser dazzling device comprising at least one heat sink, multiple laser resonators and an optical head. Each of the laser resonators extends axially from a first end, fixedly mounted to the heat sink, to a second end. The second end of each laser resonator emits an individual laser beam along a light path. The optical head is disposed adjacent to the second ends of the laser resonators and includes an optical transmission assembly that directs and aligns the individual laser beams of the laser resonators to define a region of overlap at a remote point a predetermined distance from the optical head The optical transmission assembly comprises optical elements selected from an individual lens, a set of individual lenses, a semi-transparent mirror, a polarizing beam splitter or a combination of beam conditioning optics, and directs the individual laser beams of the laser resonators to be parallel, to converge or to diverge.

The optical transmission assembly may comprise multiple collimating, aligning, or focusing lenses, where one of the collimating or focusing lenses is associated with each of the laser resonators. The collimating or focusing lenses align each individual laser beam substantially parallel to each other individual laser beam.

The optical transmission assembly may comprise multiple collimating or focusing lenses, where one of the collimating or focusing lenses is associated with each of the laser resonators. The collimating or focusing lenses align each individual laser beam substantially parallel to each other individual laser beam and direct the individual laser beams through a common focusing lens that is aligned with and movable along a common optical axis.

The optical transmission assembly may comprise multiple collimating or focusing lenses, where one of the collimating or focusing lenses is associated with each of the laser resonators. The collimating or focusing lenses angle each individual laser beam away from the common optical axis and direct the individual laser beams through a common focusing lens that is aligned with and movable along a common optical axis.

The optical transmission assembly may comprise a common focusing lens aligned with the common optical axis.

The compact high power laser dazzling device further comprises a laser beam intensity adjuster assembly disposed adjacent the output end of the optical head. Alternatively, the output end portion of the optical head may include the laser beam intensity adjuster assembly. The laser beam intensity adjuster assembly includes a front face having multiple apertures. At least one of the apertures has a holographic diffuser element mounted therein and at least one of the apertures has an optically clear window element or no optical elements mounted therein.

The front face of the laser beam intensity adjuster assembly has N apertures, where N is equal to two times the number of laser resonators. Holographic diffuser elements are mounted within a first half of the apertures and optically clear window elements or no optical elements are mounted within a second half of the apertures. Each aperture having a holographic diffuser element mounted therein is disposed adjacent an aperture having an optically clear window element or no optical element mounted therein.

The front face is rotatable with respect to the axis of the optical head from a first position to a second position, where the apertures having the optically clear window element or no optical element mounted therein are aligned in the light path of the individual laser beams when the front face is in the first position, and the apertures having the holographic diffuser mounted therein are aligned in the light path of the individual laser beams when the front face is in the second position.

The laser beam intensity adjuster assembly may further include a spring biased pin or wave washer and stop configuration to lock the front face in either the first position of the second position.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION OF THE PREFERRED EMBODIMENT

Figure 1:
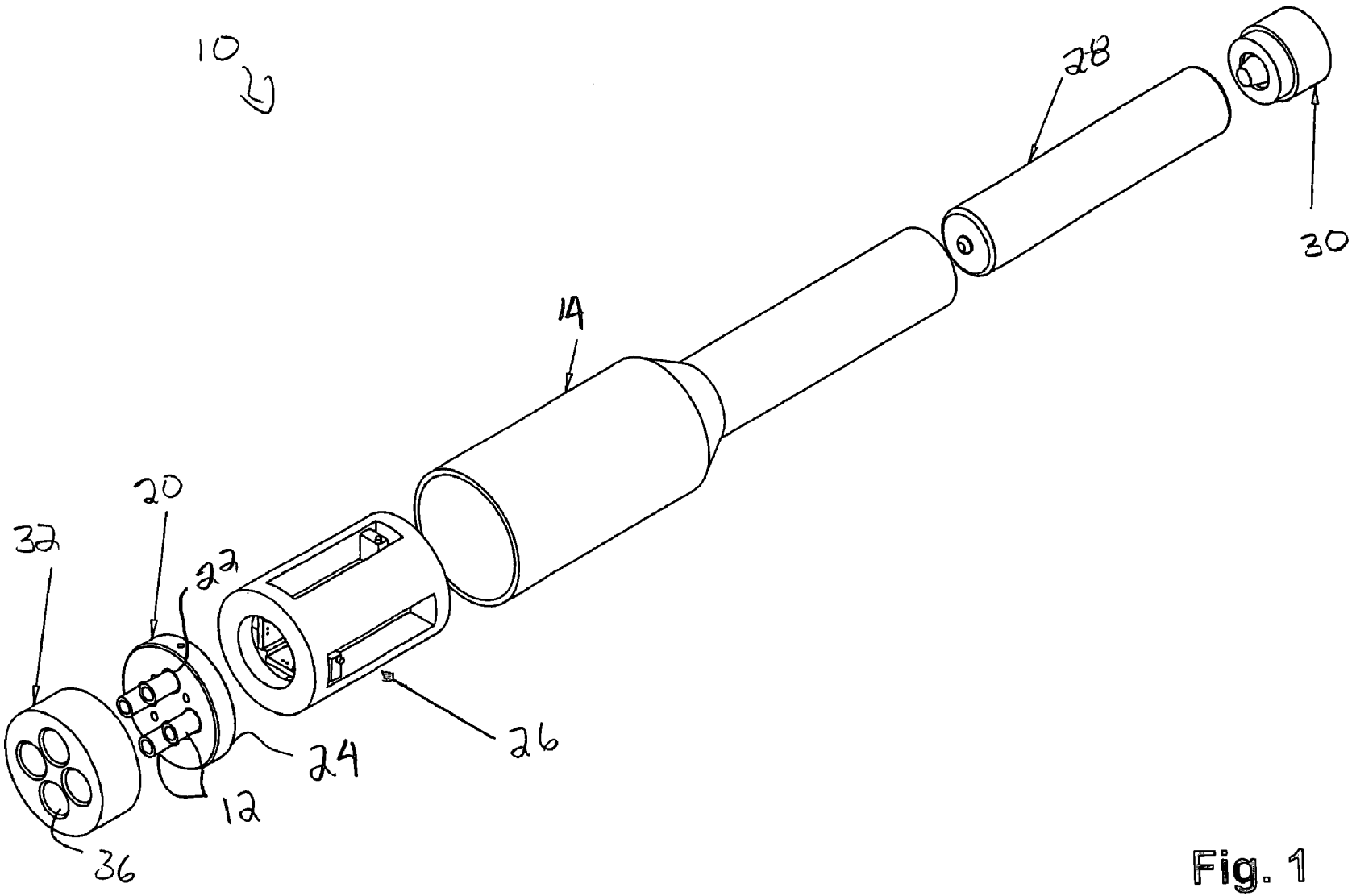
FIG. 1 is a simplified schematic view of a first embodiment of a portable light emitting laser dazzling device of the disclosure.

The present disclosure provides a method and apparatus for increasing the light intensity of a non-lethal laser dazzling device 10, 10' by superimposing the outputs of a multiplicity of high brightness laser resonators/emitters 12, contained within a single, compact housing 14. The high brightness light sources comprise, in preferred embodiments, single lasers, each emitting a dispersion pattern of radiation, preferably in the visible to near-IR spectral range. While the optical axes 16 of the emitted beams 18 may or may not be parallel, the natural divergence of the light beams 18 causes them to cross at some distance away, which can be selected to coincide with the location of the target. This results in an increase in the overall intensity at the target's location and, since the overlap is not perfect, provides generally a wider area of illumination.

Whereas the key principle of the disclosure comprises a straightforward superposition of the laser beams 18 at a location remote from the emitting device 10, 10' due to the natural divergence of light, a variety of devices may be built according to these principles, incorporating one or more additional restrictions and modifications aiming at specific applications. For example, in the case of non-lethal security devices, care must be taken to ensure that the combined intensity at the point of greatest overlap is maximally effective in producing the desired visual disorientation effect but without exceeding the eye safety limits. Thus, a burst of bright light produced when the laser emitters 12 are turned on simultaneously may startle the subject enough for him/her to become disoriented, thereby affording law enforcement personnel enough time to apprehend and/or control a potentially violent subject. The flashblinding effect on the eye's retina must however, remain temporary so that full visual acuity may be eventually recovered with no lingering adverse effects. It is noted that the intended use of a preferred embodiment of the small aperture devices 10, 10' built according to principles taught in this disclosure is for disorientation and visual impairment at ranges generally longer than about 20 meters, even under bright ambient conditions. However, additional and/or alternative features allow structural and functional modification of the basic laser dazzling device for other uses and/or applications, while maintaining its portability, reliability and cost effectiveness aspects.

With reference to the drawings wherein like numerals represent like parts throughout the several figures, a first embodiment of a compact high power laser dazzling device in accordance with the present disclosure is generally designated by the numeral 10. Several laser resonators/emitters 12 are mounted in a single resonator head 20 adjacent to each other. For example, the compact high power laser dazzling device 10 of FIG. 1 includes four laser resonators/emitters 12. It should be understood that the four laser resonators/emitters 12 shown in FIG. 1 are provided by way of an illustrative example and not by way of limitation.

The laser emitters/resonators 12 each have one end 22 fixedly/permanently mounted to individual or common heat sinks 24 and mounted together on a common platform 20 adjacent to each other in an array with inter-emitter spacings dictated by the laser dazzling device's physical constraints. The heat sink(s) 24 may be passive with no active temperature control provided in conjunction with the electronics module 26 or active temperature control and stabilization thereby maintaining the operating temperature within the optimal operating range for the laser resonators. The electronics module 26 can either provide and maintain a predetermined constant current to the emitters/resonators 12, or provide temperature control and or a varying current to maintain a desired power level. The laser emitters 12 are fixedly/permanently mounted to the heat sink(s) 24 to achieve the best possible thermal conductivity from the laser resonator 12 to the heat sink 24.

In a preferred embodiment, the laser emitters 12 comprise solid state lasers end-pumped by commercially available diode lasers. A description of diode pumped, frequency doubled Nd-doped lasers that may be especially suitable as single emitter sources for the compact laser dazzling device of the present disclosure was provided in U.S. Pat. No. 6,799,868, U.S. Pat. No. 6,616,301 and U.S. Pat. No. 6,142,650, incorporated in their entirety by reference herein. While green radiation may be preferred for the purpose of maximizing the effectiveness of security devices, other compact laser sources providing alternative wavelengths fall within the scope of the disclosure. These include semiconductor lasers which emit radiation predominantly in the red, optically pumped semiconductor lasers (OPS) such as the blue sapphire lasers produced by Coherent Inc., diode pumped fiber lasers, and various other embodiments of solid state lasers that emit light across the spectrum from the visible into the near-infrared.

Also shown in FIG. 1 is a power source 28 for driving the emitters 12 operatively coupled to a power switch 30 which allows an operator to manually control the "on/off" modes of operation, In preferred embodiments, the power source 28 comprises a commonly utilized battery or a set of batteries and the associated electronic circuitry.

The radiation produced by the individual laser emitters 12 is coupled to an optical head 32 containing an optical transmission assembly 34, 34', 34", 34'" followed by a transparent exit window 36, generally located at the output end of the laser dazzling device 10, opposite to the power switch 30. Since the laser resonators 12 are fixedly mounted to the heatsink(s) 24 to achieve the best possible thermal conductivity, it is not possible to adjust the individual resonators 12 to achieve alignment in relation to the device axis 44. The optical elements of the optical transmission assembly 34, 34', 34", 34'" provide the means to align the laser beams emitted by the laser resonators 12.

In various embodiments, the optical transmission assembly 34, 34', 34", 34'" may comprise separate optical elements, each coupled to one of the beams disposed along its own axis 16, as shown in the example of FIG. 1. Alternatively or additionally, a single optic is disposed along a principal optical axis of the laser dazzling device, providing common means for optically conditioning the individual beams prior to exiting the laser dazzling device 10 through the transparent window 36. The optical element(s) comprising the optical transmission assembly 34, 34', 34", 34'" may consist of a lens or a set of individual lenses designed to collimate, focus or expand the beams from the individual emitters 12 individually or collectively. Alternatively, the optical transmission element(s) may comprise a semi-transparent mirror, a polarizing beam splitter or any combination of beam conditioning optics known in the art of optical system design.

The output from the laser dazzling device 10, 10' comprises individual beams which can be parallel, converge or even diverge, so as to enable variations in the overlap zone of the beams at a remote point a given distance away. FIGS. 2–5 show several optical configurations for conditioning the output from the four laser example of FIG. 1.

Figure 2:
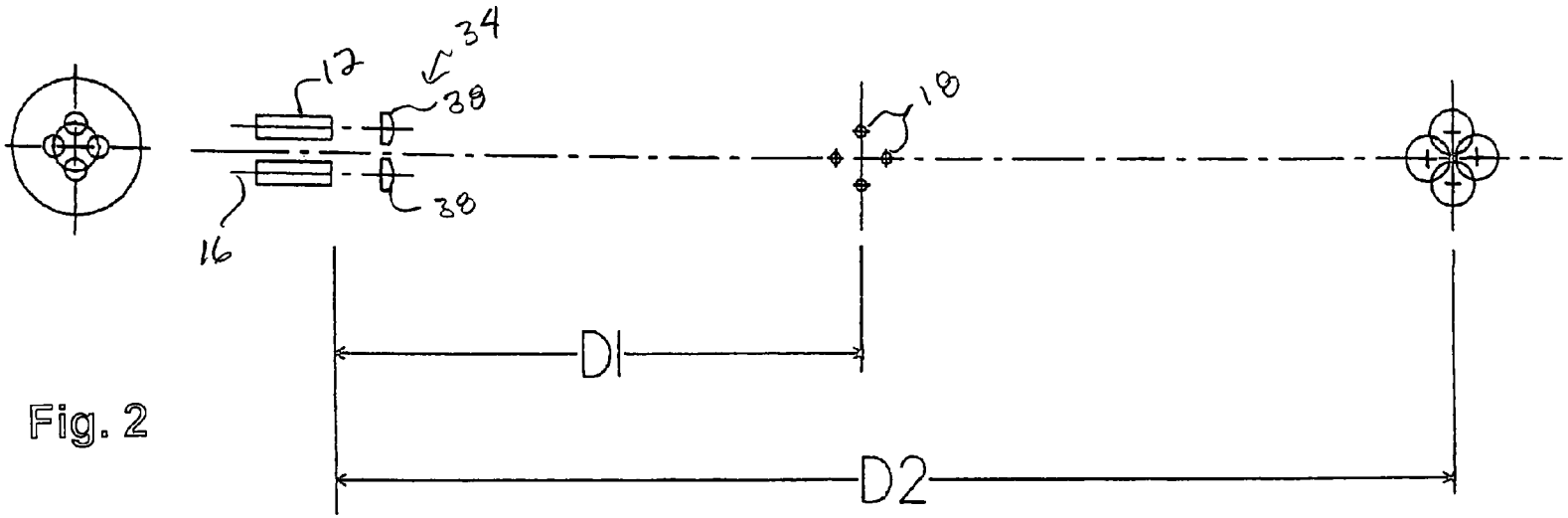
FIG. 2 is a simplified schematic view of a first embodiment of an optical transmission assembly with the laser resonators of FIG. 1.

In the laser dazzling device of FIG. 2, the optical transmission assembly 34 comprises four separate collimating or focusing lenses 38, with the output radiation from each of the four individual emitters 12 being separately coupled to a corresponding collimating or focusing lens 38. In this case, the individual laser beams are first aligned substantially parallel to one another by the optical transmission assembly 34, resulting in four individual light beams that propagate in substantially the same direction. As the beams propagate, divergence causes the respective spot sizes to increase until they start to overlap. At some distance D2 (assumed to be in the far field) the beams will effectively coalesce into a single illumination spot area with a concentrated intensity zone in the center where overlap is maximized. Lenses 38 can thus be selected to provide a known region of overlap as a function of distance, given knowledge of the initial beams' spatial profile, divergence properties and spatial offset between the beams. The distances D1 and D2 marking din FIG. 2 two distances from the emitting face (assumed to be on a common plane for all four emitters 12), correspond to limiting cases where the combined intensities may each be calculated to be minimal, maximal or optimal, and will generally depend upon the mission requirements.

Figure 3:
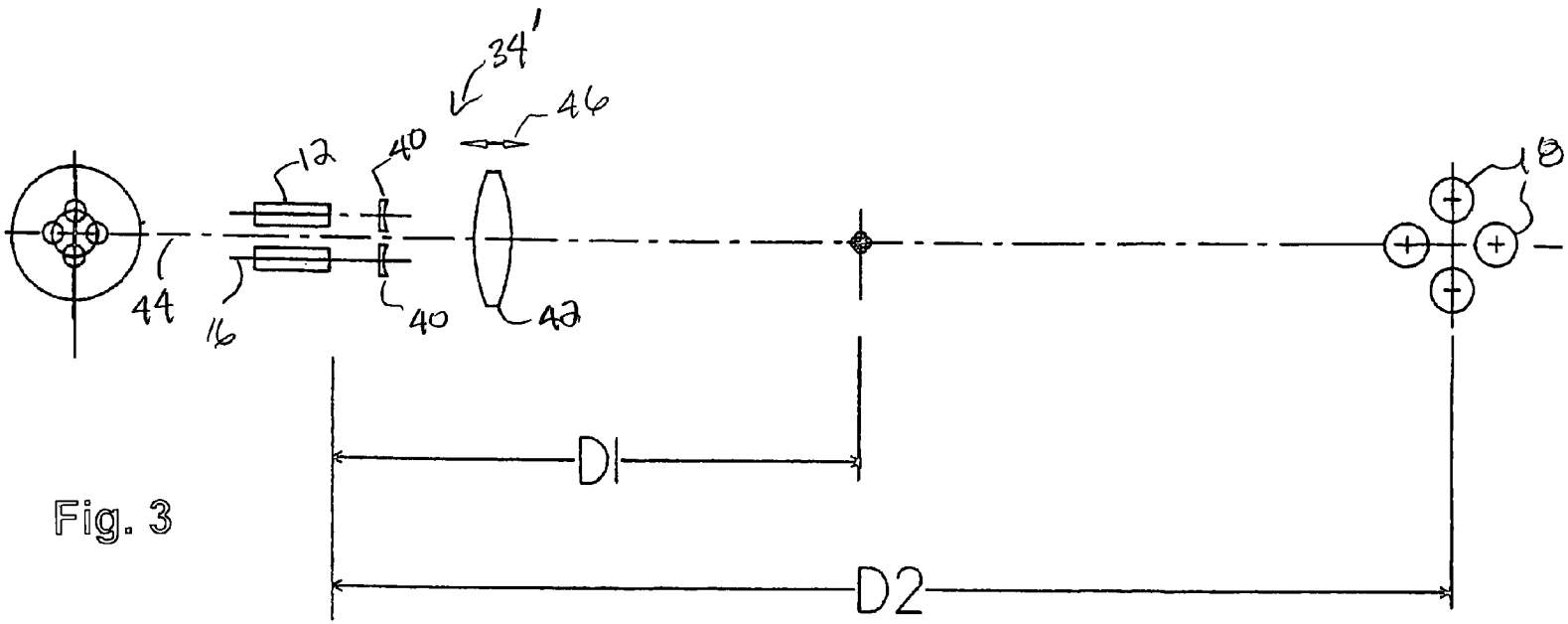
FIG. 3 is a simplified schematic view of a second embodiment of an optical transmission assembly with the laser resonators of FIG. 1.
Figure 4:
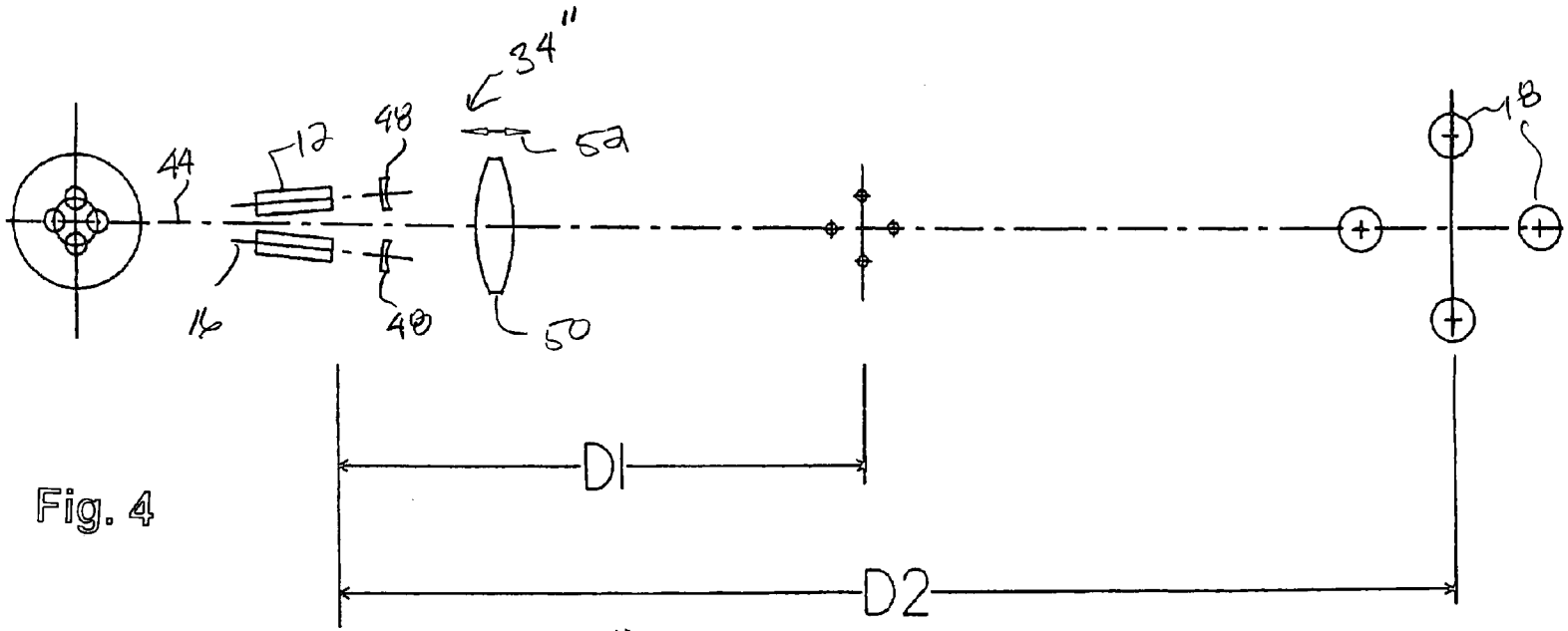
FIG. 4 is a simplified schematic view of a third embodiment of an optical transmission assembly with the laser resonators of FIG. 1.

In the laser dazzling device of FIG. 3, the optical transmission assembly comprises four individual collimating lenses, followed by a common focusing lens, which can be translated along the common optical axis, as indicated by the arrow. In this case, the four beams are indicated as being brought to a common focused spot at distance D1, beyond which they diverge, until the spot sizes separate entirely at distance D2. In the laser dazzling device of FIG. 4, the optical transmission assembly also comprises four individual collimating lenses, followed by a common focusing lens, which can be translated along the common optical axis, as indicated by the arrow. In this case, the individual beams are initially angled relative to each other by the collimating lenses, away from the common optical axis, thereby resulting in separate non-overlapping spots at distance D1, and only minimal overlap at distance D2. In the laser dazzling device of FIG. 5, the optical transmission assembly comprises only a single common lens focusing the beams to spot sizes that may be individually offset from one another along the common axis due to variations in the emitters spatial beams' properties. In the laser dazzling device of FIG. 5, the optical transmission assembly comprises four separate collimating or focusing lenses, with each of the collimating or focusing lenses being followed by a corresponding In a preliminary demonstration of a laser dazzling device 10 constructed according to the principles of the disclosure, a combined power of 550 mW was achieved at 50% duty cycle from four diode pumped frequency doubled lasers operating at 532 nm and built according to the embodiment described in U.S. Pat. No. 6,799,868 (incorporate by reference herein). This technology can be optimized and scaled to provide full CW power at 1.1 W with a TEM00 beam, corresponding to over 260 mW from each individual laser dazzling device. By packaging the four laser emitters 12 in a single portable laser dazzling device 10 built in a manner similar to the one shown in FIG. 1, such a power performance compares well with the maximum of 200 mW currently available from a single laser dazzler device, or any other prior art device including any that are commercially available.

Table 1 shows a comparison of the maximum intensity (or energy density) levels that may be achieved at these power levels for different ranges from a simple laser dazzling device built using four collimated laser beams overlapping in the far field as was shown in FIG. 2. In this table, the energy density is given at 50% duty cycle, at 100% duty cycle (full CW power) and at the peak of the intensity, assuming overlap between perfect diffraction limited Gaussian beam profiles (corresponding to another factor of 2 in the last column of Table 1).

TABLE 1

| Distance to Target (m) | Spot Diameter (cm) | Energy Density (W/cm2) 50% dc | 100% dc | Gaussian peak |
|---|---|---|---|---|
| 10 | 17.3 | 2.3 | 4.7 | 9.3 |
| 25 | 43.4 | 0.4 | 0.7 | 1.5 |
| 50 | 86.7 | 0.1 | 0.2 | 0.4 |
| 75 | 130.1 | 0.04 | 0.08 | 0.2 |
| 150 | 260.2 | 0.01 | 0.02 | 0.04 |

Energy Density (intensity) at different ranges for the case of four parallel beams with total power of 550 mW at 50% duty cycle (dc). Projected intensities at 100% duty cycle (factor of 2) and at the peak of the intensity (another factor of 2) are also shown.

As was shown in FIG. 2 of U.S. Pat. No. 6,799,868 and the associated discussion therewith, a minimum of 10 ms exposure time is required to produce flashblinding or disorientation effects, which translates to a minimal beam intensity at the location of the subject's eyes of about 5.7 mW/cm2. Generally, lower threshold intensities are required the longer is the exposure time. For a 250 ms exposure, corresponding to the typical blink response, the threshold intensity for dazzling a subject is about 2.6 mW/cm2. The required intensity for an effective laser dazzler in the spectral range of 400 and 550 nm must therefore be at least 3 mW/cm2 and preferably over 5 mW/cm2. Yet it must also remain below 26 mW/cm2, and preferably below 20 mW/cm2 in order to avoid permanent injury. As the comparison in Table 1 shows, the available energy densities from the far field overlap between four parallel beams are effective only out to a range of about 10 m even at full CW power from TEM00 beams. Intensities beyond this range drop sharply because the size of the overlap zone decreases rapidly as a function of distance in this case.

Figure 5:
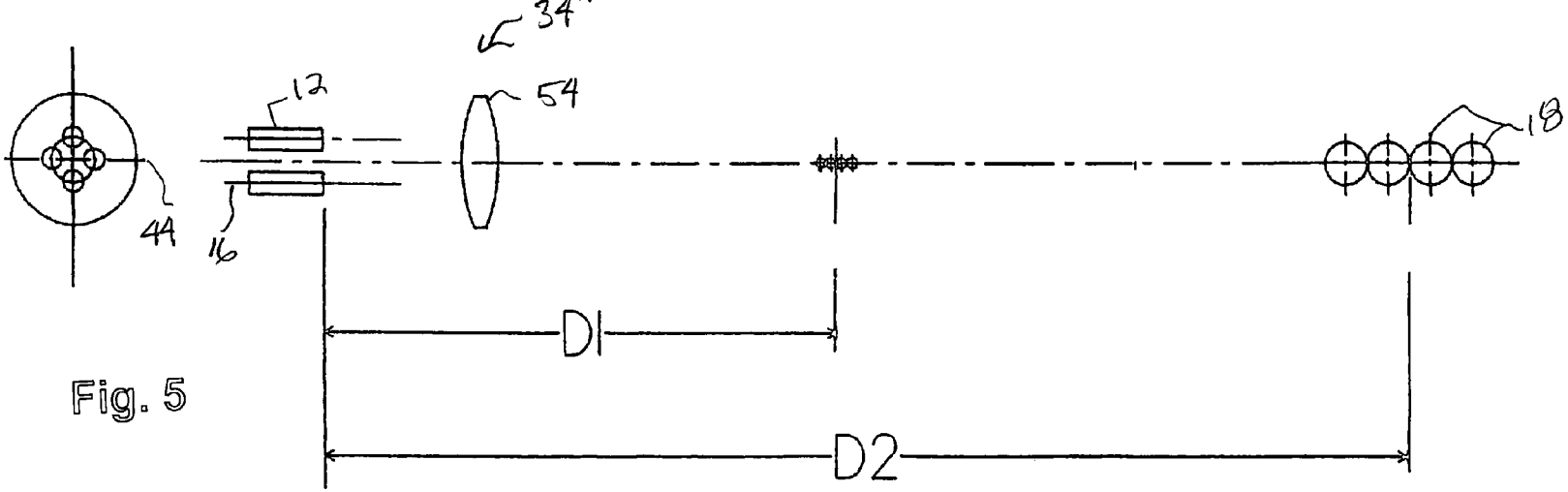
FIG. 5 is a simplified schematic view of a fourth embodiment of an optical transmission assembly with the laser resonators of FIG. 1.
Figure 6:
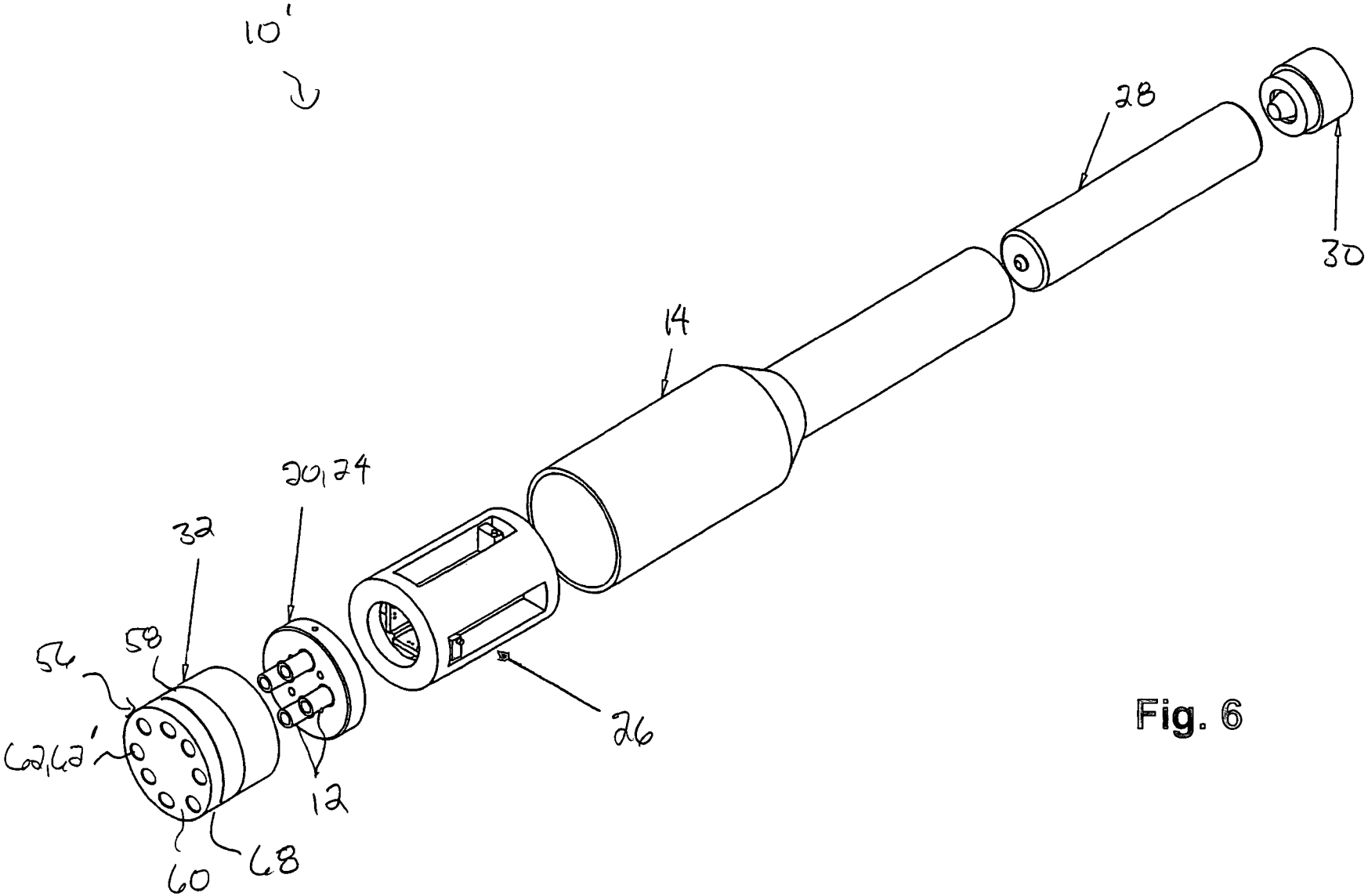
FIG. 6 is a simplified schematic view of a second embodiment of a portable light emitting laser dazzling device of the disclosure.

In order to effectively cause disorientation of a subject at longer ranges, an optical configuration using a focusing lens arrangement similar to FIGS. 3 and 5 may be preferred. Table 2 shows an example of the energy intensities calculated at the point of maximum overlap at different ranges using the same power levels used above for the calculations shown in Table 1 but with each of the four beams now individually or collectively focused by a 15 mm focal length lens. Using the same criteria for calculating the resultant intensities indicates that even with such relatively low available power, a laser dazzling device constructed according to the principles described in this disclosure may be effective out to a range of 25 m with 50% duty cycle, extending to 50 m for the case of full CW Gaussian beam profiles. As further shown in Table 2, the laser dazzling device should not be utilized with a full CW power at shorter ranges (below 25 m) in order to comply with eye safety considerations.

Further scaling of the power output is possible using additional laser generators or by increasing the power from each laser. The examples shown in FIGS. 1–5 and Tables 1 and 2 corresponded to the special case of four lasers. More generally, the subject disclosure generally can covers any arrangement with three or more laser beams, up to as many as 20.

TABLE 2

| Distance to Target (m) | Spot Diameter (cm) | Energy Density (W/cm2) 50% dc | 100% dc | Gaussian peak |
|---|---|---|---|---|
| 10 | 6.5 | 16.4 | 32.7 | 65.5 |
| 25 | 16 | 2.8 | 5.5 | 11 |
| 50 | 32.7 | 0.7 | 1.3 | 2.6 |
| 75 | 49 | 0.3 | 0.6 | 1.2 |
| 100 | 65 | 0.17 | 0.33 | 0.67 |
| 150 | 98 | 0.07 | 0.15 | 0.3 |
| 200 | 130 | 0.04 | 0.08 | 0.17 |

Energy Density (intensity) at different ranges for the case of four parallel beams focused by 15 mm fl lens and with total power of at least 550 mW at 50% duty cycle (dc). Projected intensities at 100% duty cycle (factor of 2) and at the peak of the intensity (another factor of 2) are also shown.

The limitations on the number of sources consist primarily of physical and power supply constraints. Thus, the efficiency and compactness of the individual laser sources are important criteria in allowing an increase the number of sources while maintaining portability of the laser dazzling device 10, 10'.

Further extensions of the functionality of the laser dazzling devices 10, 10' of the present disclosure can be derived by relaxing the requirement that the beams be all delivered simultaneously and/or that they operate in a CW mode. In an alternative embodiment, the same general platform for multiple laser sources may be modified by including modulation means in the electronic control system to thereby enable delivery of the combined beams at different modulation rates, either simultaneously or sequentially according to selected timing of the beams. Utilization of several laser sources packaged in a single laser dazzling device also allows operation in alternative modes that are not possible or economical with a single emitter. Selected special modes include alternating between pulsed and CW operation, altering the pulse duration of the emitted beams and/or using lasers with different spectral outputs thereby producing a range of spectral components that can defeat any potential countermeasures—such as optical filters. It is noted that operating the lasers in a pulsed mode may be especially beneficial in bright ambient conditions and the ability to alternate between pulsed and CW provide a feature that allows a single laser dazzling device to be effective across a variety of ambient conditions.

As was noted above, the laser resonators 12 packaged in the laser dazzling device 10, 10' of the disclosure may all comprise the same type of laser or they may be different. Laser sources that could be advantageously deployed in various devices include, but are not limited to, diode pumped solid state lasers, fiber lasers or semiconductor lasers. Regardless of which laser, or lasers are used in a given laser dazzling device, the beams generated by the individual sources may all have the same parameters or they may differ in one or more parameters, such as wavelength, pulse duration and beam profiles. Therefore any type of solid state laser that can be constructed to be compact enough to be packaged in a laser dazzling device such as the one shown in FIG. 1 and containing multiple sources falls under the scope of the disclosure.

One important criterion in selecting the lasers and the laser array configuration is that the beam combination be incoherent in nature, anywhere along the path where the beams overlap. This limitation is necessary in order to avoid spurious and/or undesirable interference effects, which can give rise to potentially deleterious "hot spots" and/or speckle effects. Thus, avoiding hot spots is essential for assuring eye safety anywhere within the preferred illumination range. Speckle effects can also compromise the efficacy of the laser dazzling device as well as admitting the possibility of retinal injury by presenting a target with randomly varying darker and brighter spots. One way to ensure that the beams are not coherent with each other, and avoiding speckle effects, is to avoid single longitudinal mode lasers or lasers with overly long coherence lengths. Other alternatives include slightly offsetting the wavelengths of the sources from one another just enough to broaden the overall spectral bandwidth, pulsing or modulating the lasers sequentially, offsetting the phase of the lasers or selecting different beam polarizations.

Generally, varying the "on" time of the laser sources, individually or collectively is one of the features provided by the laser dazzling devices of the disclosure in order to enable addressing different tactical situations and alternating weather conditions. This feature must take into account, however, the desired exposure time as well as constraints on the duty cycle imposed by available battery power. Exposure times that are generally shorter than the blink response time of ¼ s are typically utilized. Since the damage threshold to the retina increases as the exposure time decreases, the laser dazzling device of the disclosure is assured of eye safety for any exposure time below 250 ms as long as with maximum intensities at the desired range remain below 26 mW/cm2 and preferably no higher than about 20 mW/cm2.

It should further be noted that whereas FIGS. 2–5 show four specific configurations appropriate to four laser beams, this was provided as an example and not by way of limitation. Thus there may be many other possible optical configurations that can be incorporated in the apparatus and method of the disclosure, depending on the tactical mission requirements and desired laser dazzling device functionalities, as well as any economic and weight limitations. Thus, it is apparent from the options shown in FIGS. 2–5 that laser dazzling devices may be built providing arbitrarily large or small illumination areas with selectable beam overlap zones located at different ranges with specific illumination patterns. Depending on the number, available power, divergence and wavelengths available from the individual emitters 12 as well as the spatial configuration of the array of emitters, optical transmission assembly 34, 34', 34", 34'", can, for example, be selected to cover a wider or smaller area at prescribed ranges.

In one example, potentially useful to a demanding security function, providing a wider beam overlap area may allow interception of a rapidly moving target or a number of different targets. In another scenario, a moving lens may provide alternate modes of operation ranging from benign areal illumination to a tactical security function. Thus, in one particular embodiment, the power or duty cycle can be turned down enough to allow the laser dazzling device of the disclosure to be utilized as an emergency signal light similar to what was taught in U.S. Pat. No. 6,805,467, incorporated by reference herein. At higher powers, the same laser dazzling device can then be used as an effective security means, providing intensities sufficient to produce the requisite disorientation effects. For such a dual function, the angled optical configuration of FIG. 4 may be especially useful in providing greater control of the total power over a wider area at a prescribed distance from the laser dazzler device. Even more complex functional options may be provided by selecting an arrangement of the laser resonators that forms an array operatively designed to generate a specific pattern of output beams. Such a pattern generated can then be alternatively "tightened" (i.e., with less space between the beams) or "loosened", for example, by use of a prism, a lens or mirrors, which effectively combine the beams at different positions relative to one another.

In still another example, the type and spatial pattern of the laser sources may be selected to allow countermeasure operation against specific optical sensors, including viewing, imaging and detecting devices. Such tactical applications may generally require a reassessment of the required powers, ranges and target intensities under different brightness conditions, but the flexibility and adaptability of the portable platform of the disclosure may provide a promising match for many such different scenarios.

Thus the present disclosure provides a versatile and flexible platform to improve and extend the performance of light based security measures so they can be adapted for the purpose of accomplishing different missions and/or functions. Devices 10, 10' constructed according to the principles of the disclosure utilize a plurality of high-brightness light sources powered by a simple battery to thereby provide higher powers and greater versatility than is possible from a single emitter. Use of a plurality of laser resonators 12 packaged in single portable laser dazzling device 10, 10' provides a cost effective capability extension by taking advantage of tight overlap pattern generated by propagation and dispersion properties of laser beams. Numerous optical designs can be implemented that may allow for smaller or larger beam overlap areas, thereby providing a scalable and variable feature over the prior art fixed illumination pattern devices. Use of multiple laser resonators 12 further carries the inherent advantage of redundancy in that the laser dazzling device can remain operational even if one of the sources fails. This translates into extension of the overall lifetime of the laser dazzling device while reducing the risk of total laser dazzling device failure at a critical time during the mission.

Figure 7:
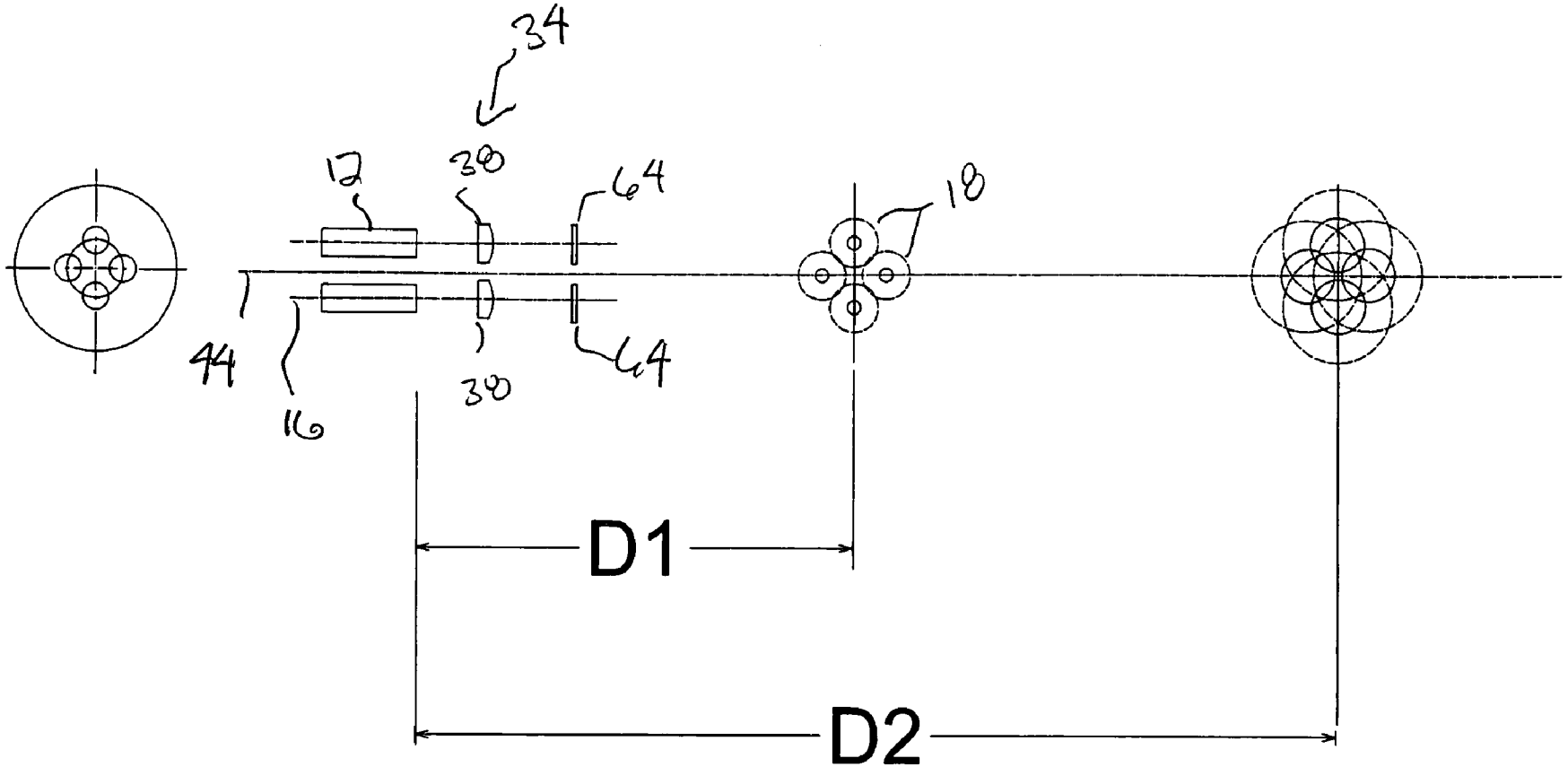
FIG. 7 is a simplified schematic view of the optical transmission assembly of FIG. 2 with the laser resonators and holographic diffuser elements of FIG. 6.
Figure 9:
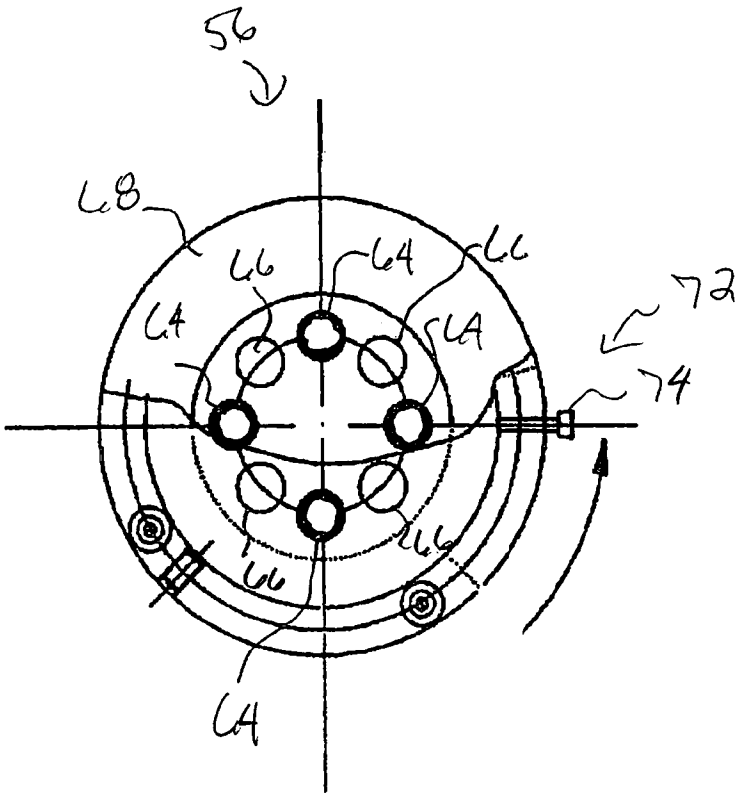
FIG. 9 is a simplified schematic view, partly in phantom, of the laser beam intensity adjuster assembly of FIG. 7, showing the housing front segment in the second position.
Figure 8:
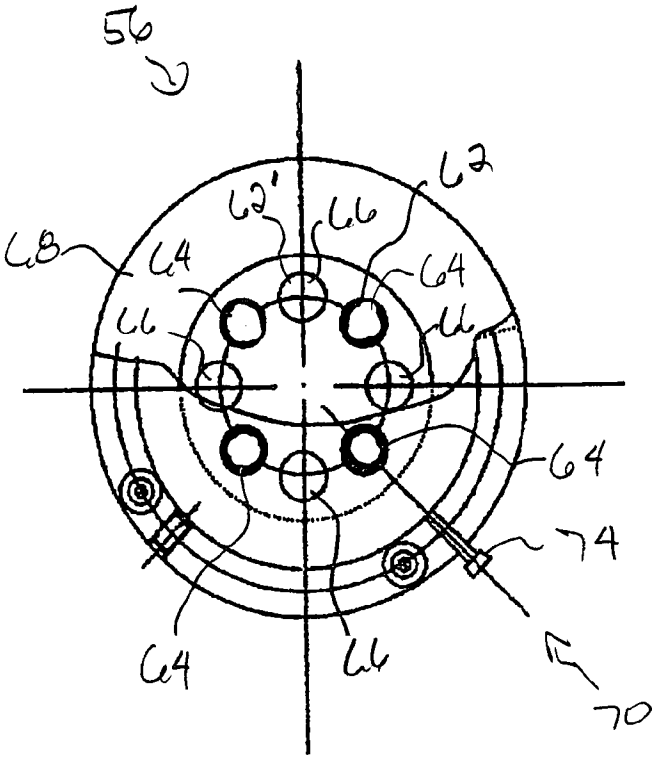
FIG. 8 is a simplified schematic view, partly in phantom, of the laser beam intensity adjuster assembly of FIG. 7, showing the housing front segment in the first position.

With reference to FIGS. 6–9, a second embodiment of the compact high power laser dazzler 10' includes a laser beam intensity adjuster assembly 56 mounted at the output of the optical head 32. The laser beam intensity adjuster assembly 56 includes a housing 58 having a front face 60 having a number N of apertures 62, 62', where N equals two times the number of laser emitters 12. Holographic diffuser elements 64 are mounted within half of the apertures 62. Preferably, optically clear window elements 66 are mounted within the other half of the apertures 62'. Alternatively, apertures 62' may be left empty. As shown in FIGS. 8 and 9, the holographic diffuser elements 64 are mounted in the "odd number" apertures 62 and the optically clear window elements 66 are mounted in the "even number" apertures 62'. The front segment 68 of the housing 58 is rotatable with respect to the common axis 44 of the optical head 32, from a first position 70 to a second position 72. In the example of FIGS. 8 and 9, the front segment 68 rotates 45 degrees between the first and second positions 70, 72. In the first position 70, the optically clear window elements 66/open apertures 62' are aligned with the axis 16 of the laser emitters 12. In the second position 72, the holographic diffuser elements 64 are aligned with the axes 16 of the laser emitters 12. The laser beam intensity adjuster assembly 56 may include a spring biased pin 74 to lock front segment 68 in either the first position 70 or the second position 72.

The laser beam intensity adjuster assembly 56 provides great flexibility of use for the compact high power laser dazzler 10'. When aligned with the axes 16 of the laser emitters 12, the optically clear window elements 66/open apertures 62' have no effect on the intensity of the laser beams emitted from the laser resonators 12, allowing the laser beams to exit as determined by the optical transmission assembly 34, 34', 34", 34'", thereby allowing the compact high power laser dazzler 10' to be utilized at the maximum possible distance provided by combination of the optical transmission assembly 34, 34', 34", 34'" and the laser emitter 12. When aligned with the axes 16 of the laser emitters 12, the holographic diffuser elements 64 greatly diffuse the laser beams emitted from the laser resonators 12, allowing the compact high power laser dazzler 10' to be utilized at much closer distances without the possibility of eye damage at these closer distances. Depending on the specific holographic diffuser elements 64 that are used, the minimum required eye safe "stand off" distance can be reduced by 90% or more.

The effect of the holographic diffuser elements 64 is best illustrated by comparing the laser beams 18 shown in FIG. 7 to the laser beams 18 shown in FIG. 2, where device 10' and device 10 have identical laser resonators 12 and identical optical transmission assemblies 34.

The principal function of the laser dazzling device 10, 10' of the disclosure is to produce disorientation of potentially disruptive subject or subjects at ranges that are long enough to safely allow effective and non-lethal counter action by security forces, even under adverse conditions, such as bright sunlight. At the same time, care is taken to assure that the properties of laser resonators/emitters 12 and details of the optical configuration 34, 34', 34", 34'" are selected such that the light from the combined beams can produce the requisite disorientation and flashblinding effects without risking permanent damage to the eye. Other operational modalities allow the laser dazzling devices of the disclosure to offer different functionalities from a single or different laser dazzling device configurations, allowing adaptation to a variety of applications as was described in the foregoing.

While preferred embodiments have been shown and described, various modifications and substitutions may be made thereto without departing from the spirit and scope of the disclosure. Accordingly, it is to be understood that the present disclosure has been described by way of illustration and not limitation.

What is claimed is:

1. A compact high power laser dazzling device comprises:

at least one heat sink;

a plurality of laser resonators, each of the laser resonators extending axially from a first end, fixedly mounted to the at least one heat sink, to a second end, the second end of each laser resonator emitting an individual laser beam along a light path;

an optical head disposed adjacent to the second ends of the laser resonators, the optical head including an optical transmission assembly optically directing the individual laser beams of the laser resonators to define a region of overlap at a remote point a predetermined distance from the optical head; and a laser beam intensity adjuster assembly disposed at an output end of the optical head, the laser beam intensity adjuster assembly including:

a front face defining a plurality of apertures, at least one of the apertures having a holographic diffuser element mounted therein, and at least one of the apertures having an optically clear window element or no optical elements mounted therein;

wherein the optical head defines an axis and the front face is rotatable with respect to the axis of the optical head, from a first position to a second position, wherein the at least one of the apertures having the optically clear window element or no optical element mounted therein is aligned in the light oath of a one of the individual laser beams when the front face is in the first position and the at least one of the apertures having the holographic diffuser mounted therein is aligned in the light path of one of the individual laser beams when the front face is in the second position.

2. The compact high power laser dazzling device of claim 1 wherein the optical transmission assembly optically directs the individual laser beams of the laser resonators to be parallel, to converge or to diverge, whereby the region of overlap is defined.

3. The compact high power laser dazzling device of claim 1 wherein the optical transmission assembly comprises optical elements selected from an individual lens, a set of individual lenses, a semi-transparent mirror, a polarizing beam splitter or a combination of beam conditioning optics.

4. The compact high power laser dazzling device of claim 1 further comprising an electronics module, the at least one heat sink and the electronics module providing temperature control and stabilization to the laser resonators.

5. The compact high power laser dazzling device of claim 1 wherein the optical transmission assembly comprises a plurality of collimating or focusing lenses, one of the collimating or focusing lenses being associated with each of the laser resonators, the collimating or focusing lenses aligning each individual laser beam substantially parallel to each other individual laser beam.

6. The compact high power laser dazzling device of claim 1 wherein the optical transmission assembly defines a common optical axis and comprises:

a plurality of collimating or focusing lenses, a one of the collimating or focusing lenses being associated with each of the laser resonators, the collimating or focusing lenses aligning each individual laser beam substantially parallel to each other individual laser beam; and a common focusing lens aligned with and movable along the common optical axis.

7. The compact high power laser dazzling device of claim 1 wherein the optical transmission assembly defines a common optical axis and comprises:

a plurality of collimating lenses, a one of the collimating or focusing lenses being associated with each of the laser resonators, the collimating or focusing lenses angling each individual laser beam away from the common optical axis; and a common focusing lens aligned with and movable along the common optical axis.

8. The compact high power laser dazzling device of claim 1 wherein the optical transmission assembly defines a common optical axis and comprises a common focusing lens aligned with the common optical axis.

9. The compact high power laser dazzling device of claim 1 wherein the front face of the laser beam intensity adjuster assembly defines N apertures, N being equal to two times the number of laser resonators, holographic diffuser elements being mounted within a first half of the apertures and optically clear window elements or no optical elements being mounted within a second half of the apertures.

10. The compact high power laser dazzling device of claim 9 wherein each aperture having a holographic diffuser element mounted therein is disposed adjacent an aperture having an optically clear window element or no optical element mounted therein.

11. The compact high power laser dazzling device of claim 1 wherein the laser beam intensity adjuster assembly further includes a spring biased pin to lock the front face in either the first position or the second position.

12. A compact high power laser dazzling device comprises:

at least one heat sink;

a plurality of laser resonators, each of the laser resonators extending axially from a first end, fixedly mounted to the at least one heat sink, to a second end, the second end of each laser resonator emitting an individual laser beam along a light path;

an optical head disposed adjacent to the second ends of the laser resonators, the optical head defining an axis and including an optical transmission assembly optically directing the individual laser beams of the laser resonators to define a region of overlap at a remote point a predetermined distance from the optical head; and a laser beam intensity adjuster assembly disposed adjacent an output end of the optical head, the laser beam intensity adjuster assembly including:

a front face defining N apertures, N being equal to two times the number of laser resonators, a holographic diffuser element mounted within a first half of the apertures, and an optically clear window element or no optical element mounted within a second half of the apertures wherein the front face is rotatable with respect to the axis of the optical head, from a first position to a second position, wherein a one of the apertures having the optically clear window element or no optical element mounted therein is aligned in the light path of each of the individual laser beams when the front face is in the first position and the a one of the apertures having the holographic diffuser mounted therein is aligned in the light path of each of the individual laser beams when the front face is in the second position.

13. The compact high power laser dazzling device of claim 12 wherein the laser beam intensity adjuster assembly further includes a spring biased pin to lock the front face in either the first position or the second position.

* * * * *

UNITED STATES PATENT AND TRADEMARK OFFICE

CERTIFICATE OF CORRECTION

PATENT NO. : 7,239,655 B2
APPLICATION NO. : 11/399073
DATED : July 3, 2007
INVENTOR(S) : Casazza It is certified that error appears in the above-identified patent and that said Letters Patent is hereby corrected as shown below:

Column 12:

Line 6 Claim 1, after “light” delete “oath” and substitute --path--.

Line 37 Claim 6, after “lenses,” delete “a”.

Line 47 Claim 7, after “lenses,” delete “a”.

Column 14:

Line 10 Claim 12, after “wherein” delete “a”.

Signed and Sealed this

Twentieth Day of November, 2007

JON W. DUDAS
*Director of the United States Patent and Trademark Office*